US010634338B2

(12) United States Patent
Koo

(10) Patent No.: US 10,634,338 B2
(45) Date of Patent: Apr. 28, 2020

(54) SNOW REMOVING APPARATUS OF LED TRAFFIC SIGNAL LIGHT

(71) Applicant: CHUNGCHEONG INFORMATION & COMMUNICATION CO. LTD., Chungcheongnam-do (KR)

(72) Inventor: Jea H. Koo, Chungcheongnam-do (KR)

(73) Assignees: CHUNGCHEONG INFORMATION & COMMUNICATION CO. LTD., Chungcheongnam-Do (KR); ZITEK CORPORATION, Gyeonggi-Do (KR); Sual Dongyoul, Chungcheongnam-Do (KR)

( * ) Notice: Subject to any disclaimer, the term of this patent is extended or adjusted under 35 U.S.C. 154(b) by 0 days.

(21) Appl. No.: 16/097,450

(22) PCT Filed: Jun. 20, 2017

(86) PCT No.: PCT/KR2017/006456
§ 371 (c)(1),
(2) Date: Oct. 29, 2018

(87) PCT Pub. No.: WO2017/222273
PCT Pub. Date: Dec. 28, 2017

(65) Prior Publication Data

US 2019/0145616 A1 May 16, 2019

(30) Foreign Application Priority Data

Jun. 20, 2016 (KR) ..... 10-2016-0076926

(51) Int. Cl.
*F21V 5/04* (2006.01)
*F21V 23/02* (2006.01)
(Continued)

(52) U.S. Cl.
CPC ..... *F21V 29/90* (2015.01); *F21V 5/04* (2013.01); *F21V 23/02* (2013.01); *G08G 1/095* (2013.01);
(Continued)

(58) Field of Classification Search
CPC . F21V 29/90; F21V 5/04; F21V 23/02; G08G 1/095; H05B 1/0288; H05B 3/86;
(Continued)

(56) References Cited

U.S. PATENT DOCUMENTS 2,179,934 A * 11/1939 Jones ..... H05B 3/748 219/538
3,632,983 A * 1/1972 Dills ..... F24C 15/108 219/452.12
(Continued)

FOREIGN PATENT DOCUMENTS

JP 5059145 B2 10/2012
KR 10-2000-0028346 A 5/2000
(Continued)

OTHER PUBLICATIONS

Notification of Reason for Refusal issued by the Korean Intellectual Property Office dated Jun. 26, 2017 in corresponding Korean Patent Application No. 10-2016-0076926, with English translation.
(Continued)

*Primary Examiner* — Dana Ross
*Assistant Examiner* — Joseph M Baillargeon
(74) *Attorney, Agent, or Firm* — Carter, Deluca & Farrell LLP

(57) ABSTRACT

The present invention relates to a snow removing apparatus of an LED traffic signal light. More specifically, the present invention relates to a snow removing apparatus of an LED traffic signal light which detects snow accumulated on the lens of a traffic signal light and heats heating coils installed in the lens to remove snow.
(Continued)

The present invention, to achieve this purpose, is equipped with an infra-red emitting unit; an infra-red receiving unit that is installed inside a lens and receives infra-red reflected from the infra-red emitting unit; a CDS sensor installed inside a lens and which measures visible light to compensate the emitting output of the infra-red emitting unit, and; a heater that is installed in the lens and which is supplied power to generate heat, and is characterized in that the lens has a gentle curvature, with ceramic-coated coil securing grooves formed on the inside of the lens along its inside surface, with heater coils installed by inserting in the coil securing grooves.

2 Claims, 4 Drawing Sheets

(51) Int. Cl.

| | |
|---|---|
| ***G08G 1/095*** | (2006.01) |
| ***G09F 9/33*** | (2006.01) |
| ***H05B 1/02*** | (2006.01) |
| ***H05B 3/86*** | (2006.01) |
| ***F21Y 115/10*** | (2016.01) |
| ***F21W 111/02*** | (2006.01) |
| ***F21V 29/90*** | (2015.01) |

(52) U.S. Cl.
CPC ..... *G09F 9/33* (2013.01); *H05B 1/0227* (2013.01); *H05B 1/0288* (2013.01); *H05B 3/86* (2013.01); *F21W 2111/02* (2013.01); *F21Y 2115/10* (2016.08); *H05B 2203/014* (2013.01)

(58) Field of Classification Search
CPC .. H05B 1/0236; H05B 1/0238; H05B 1/0291; H05B 3/84; H05B 37/00; H05B 39/04; H05B 39/044; H05B 39/045; H05B 39/047; H05B 39/048; H05B 2214/02; F21Y 2115/10; F21W 2111/02; H02J 1/02; H02J 3/01
USPC ..... 219/220, 665, 626, 460.1, 461.1, 465.1, 219/467.1, 468.1, 219, 470, 497, 522, 219/627, 661, 667, 203
See application file for complete search history.

(56) References Cited

U.S. PATENT DOCUMENTS

| | | | | |
|---|---|---|---|---|
| 7,211,771 | B1 * | 5/2007 | Smith | E01F 9/40 116/202 |
| 2008/0231211 | A1 * | 9/2008 | Baarman | H01F 30/08 315/294 |
| 2011/0309760 | A1 * | 12/2011 | Beland | H02M 1/4258 315/201 |
| 2015/0174864 | A1 * | 6/2015 | Hatje | B32B 25/20 428/43 |

FOREIGN PATENT DOCUMENTS

| | | | |
|---|---|---|---|
| KR | 10-2006-0019904 | A | 3/2006 |
| KR | 200437312 | Y1 | 11/2007 |
| KR | 100805171 | B1 | 2/2008 |
| KR | 101117210 | B1 | 3/2012 |
| KR | 10-2012-0083828 | A | 7/2012 |
| KR | 101527591 | B1 | 6/2015 |

OTHER PUBLICATIONS

International Search Report dated Oct. 18, 2017 by the Korean Intellectual Property Office acting as the International Searching Authority for International Application No. PCT/KR2017/006456. Grant of Patent issued by the Korean Intellectual Property Office dated Sep. 27, 2017 in corresponding Korean Patent Application No. 10-2016-0076926, with translation.

* cited by examiner

SNOW REMOVING APPARATUS OF LED TRAFFIC SIGNAL LIGHT

TECHNICAL FIELD

The present invention relates to a snow removing apparatus of an LED traffic signal light. More specifically, the present invention relates to a snow removing apparatus of an LED traffic signal light which detects snow accumulated on the lens of a traffic signal light and heats heating coils installed in the lens to remove snow.

BACKGROUND ART

LED traffic signal lights have various advantages including brightness, efficiency and long life.

Conventional LED traffic signal lights lack any snow removing apparatus, leading to a problem wherein the light emitting portions of a traffic signal light being covered in accumulated snow, causing drivers or pedestrians to be unable to view the traffic signals, resulting in confusion which can potentially cause traffic accidents. Another problem caused is the inconvenience and danger from having to approach such traffic signal lights amid traffic during daytime or night to remove snow manually.

Further, there are cases wherein a ripple current flows from a controller controlling traffic signals to a conventional LED traffic signal light, and if a ripple current is applied, the LED traffic signal light can flash abnormally, causing confusion among derivers or pedestrians and causing traffic accidents.

DETAILED DESCRIPTION OF EMBODIMENTS

Technical Problem

To solve the above problems, the present invention provides a snow removing apparatus of an LED traffic signal light having: a means to block ripple voltage when a ripple current is applied to operate an LED traffic signal light; a means for temperature compensation so that a constant output voltage is maintained regardless of ambient temperature during extreme heat or extreme cold, and; a snow removing function that detects snow accumulation on the lens and has a means of automatically melting the accumulated snow.

Further, the present invention provides a snow removing apparatus of an LED traffic signal light which prevents interruption of heating of heater coils, etc. due to diffuse reflection of light or infra-red rays, and which, even in a case where snow has accumulated on one traffic signal light of a plurality of traffic signal lights, supplies power to another traffic signal light to supply power to the heater coils thereof, and maintains the supply of power to the heater coils until the snow has been completely removed.

In addition, the present invention provides a snow removing apparatus of an LED traffic signal light wherein a heat coil is installed inside the lens surface to detect the amount of snow accumulated on the lens surface, and the current flowing in a heater used for snow removal is varied depending on ambient temperature in winter to control the heat of heater coils.

Still further, the lens comprises a gently curved surface, and is characterized in that it has ceramic-coated coil securing grooves formed on the inside face of the lens, with heater coils installed by inserting into the coil securing grooves.

Technical Solution

To achieve the above-stated purpose, the present invention, which is a traffic signal light having a snow removing function, is characterized in that it comprises a power supply device that supplies power to the traffic signal light and a heater coil heating unit; in that an infra-red emitting unit having an infra-red emitting means installed thereon and an infra-red receiving unit having an infra-red receiving means installed thereon are installed additionally on the inside face or PCB of the lens to emit infra-red rays when snow accumulates on the lens and receive the emitted infra-red rays to convert and amplify the same into electrical power, with the amplified output turning on a power transistor in the heater coil heating unit, heating the heating coils.

Further, the power supply device employed in the present invention is characterized in that it further comprises: a power supply means that switches DC current from a primary coil to a secondary coil according to the switching action of a switching transistor; a control signal generating means that is connected to the secondary coil and which generates a control signal to control the duty ratio of the switching transistor; a control means that receives a signal output by the control signal generating means and controls the switching of the switching transistor to adjust the size of the voltage induced in the secondary coil of the power supply means; a power factor regulating means that improves the power factor of the power supply means; a ripple voltage prevention means to block ripple voltage of the power supply means; a resistor wherein a plurality of resistors connected serially to the secondary coil are parallelly connected between the control signal generating means and the load side of the control signal generating means while being connected between the part of the serially connected plurality of resistors from which a reference voltage output to the control signal generating means is drawn and the output ground wire, and; a reference voltage generating means that includes a negative temperature coefficient thermistor to vary the resistor value according to temperature changes of the parallelly connected resistors.

The present invention further comprises a CDS sensor that is installed on the inside of a lens and which measures visible light to compensate the transmitting output of the infra-red emitting unit, and a heater coil that is installed in the lens and which receives electrical power to generate heat, and is characterized in that the heater coil recognizes a flashing power mode through a microcomputer and carries out an automatic flashing recognition function wherein PWM data is increased according to the duration of time during which the light is turned off in order to correct for the reduced heat generation caused by the light being turned off, and in that a phase counter increases a power control counter to cause a heater control unit to increase the heat generation of a heater.

Still further, the lens comprises a gently curved surface, and is characterized in that it has ceramic-coated coil securing grooves formed on the inside face of the lens, with heater coils installed by inserting into the coil securing grooves.

In addition, the coil securing grooves employed by the present invention are characterized in that they are formed with a constant width and height, but have a height from the inside to the outside that is greater than their width.

Further, the heater coils employed by the present invention are characterized in that their thickness is greater than the width of the coil securing grooves.

Further, the heater coils employed by the present invention are characterized in that they are formed by twisting and winding a coil material around a central carbon fiber core, then coating with a temperature-buffering insulating material for high temperatures.

Benefits of the Invention

As has been examined in the above, the present invention, by determining the degree to which a heater is heated depending on the ambient air temperature in the winter, and relatively increasing the amount of power to a heater as the temperature descends below zero, is able to quickly trigger a snow removal function, while in above-zero weather, the heater is not turned on so long as the temperature is above zero even if reflective material such as snow or dust is on the lens.

Further, the present invention, by forming heater securing grooves evenly throughout the inside face of a lens and inserting and securing heater coils therein, allows for effective transfer of heat from a heater, and by coating the heater securing grooves with silicone, etc., is able to reduce the thermal impact to the lens.

BEST MODE(S)

In the following, a preferable embodiment of the present invention will be explained in detail with reference to the attached drawings. Here, parts with similar or identical functions are assigned the same signs across the drawings.

Figure 1:
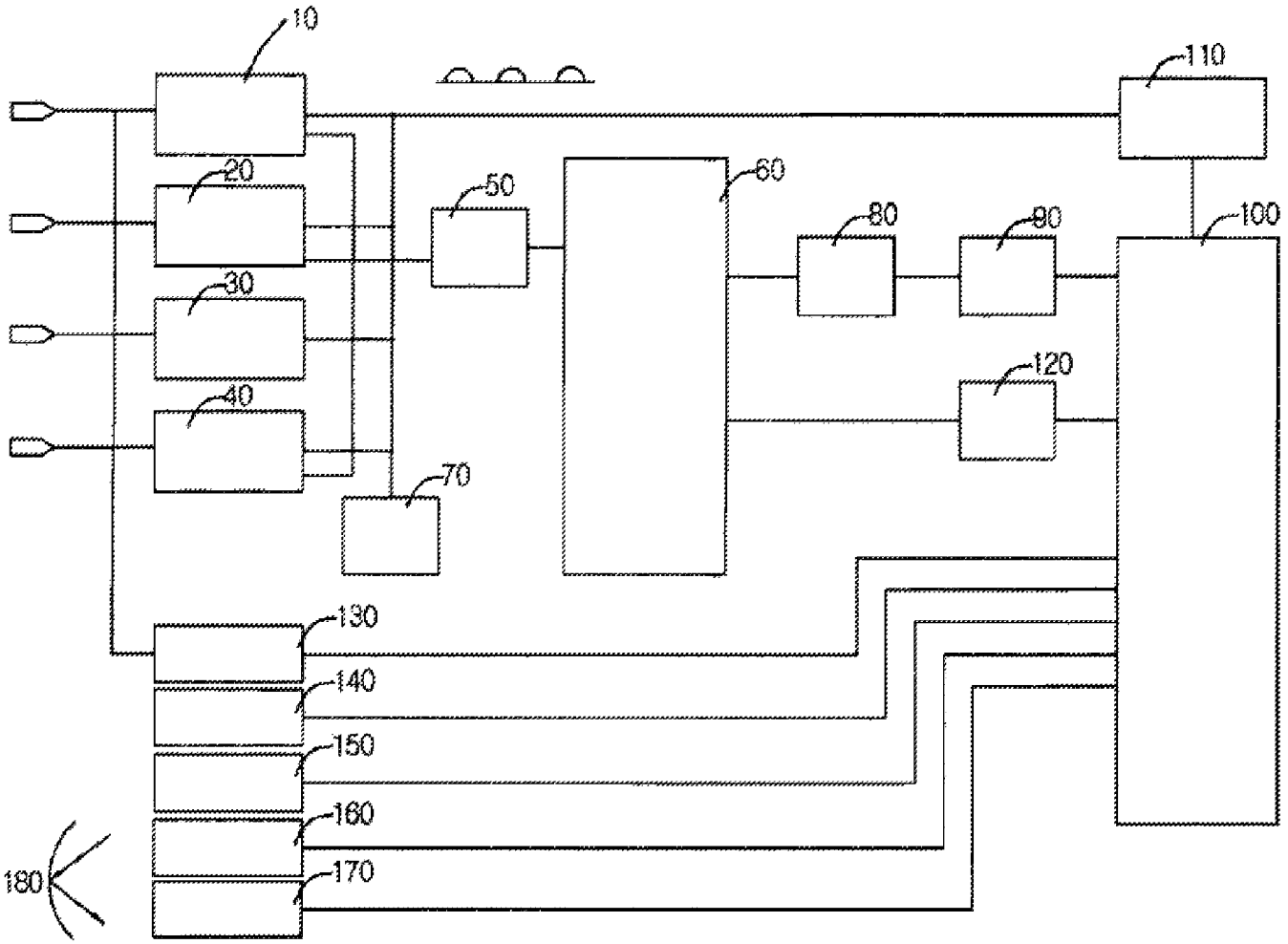
FIG. 1 is a block diagram illustrating the snow removing apparatus of an LED traffic signal light according to the present invention.
Figure 2:
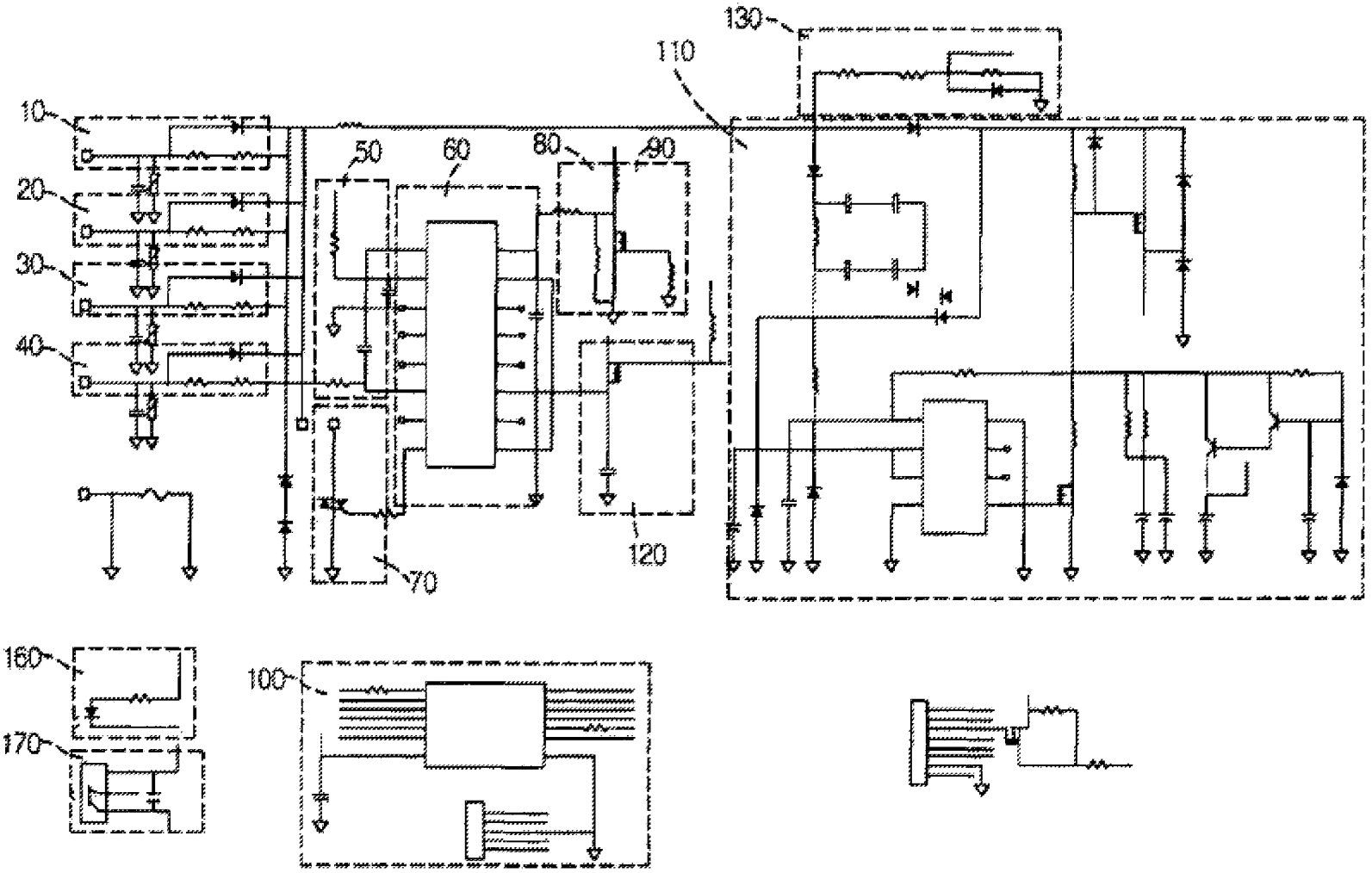
FIG. 2 is a circuit diagram for the snow removing apparatus of an LED traffic signal light according to the present invention.
Figure 3:
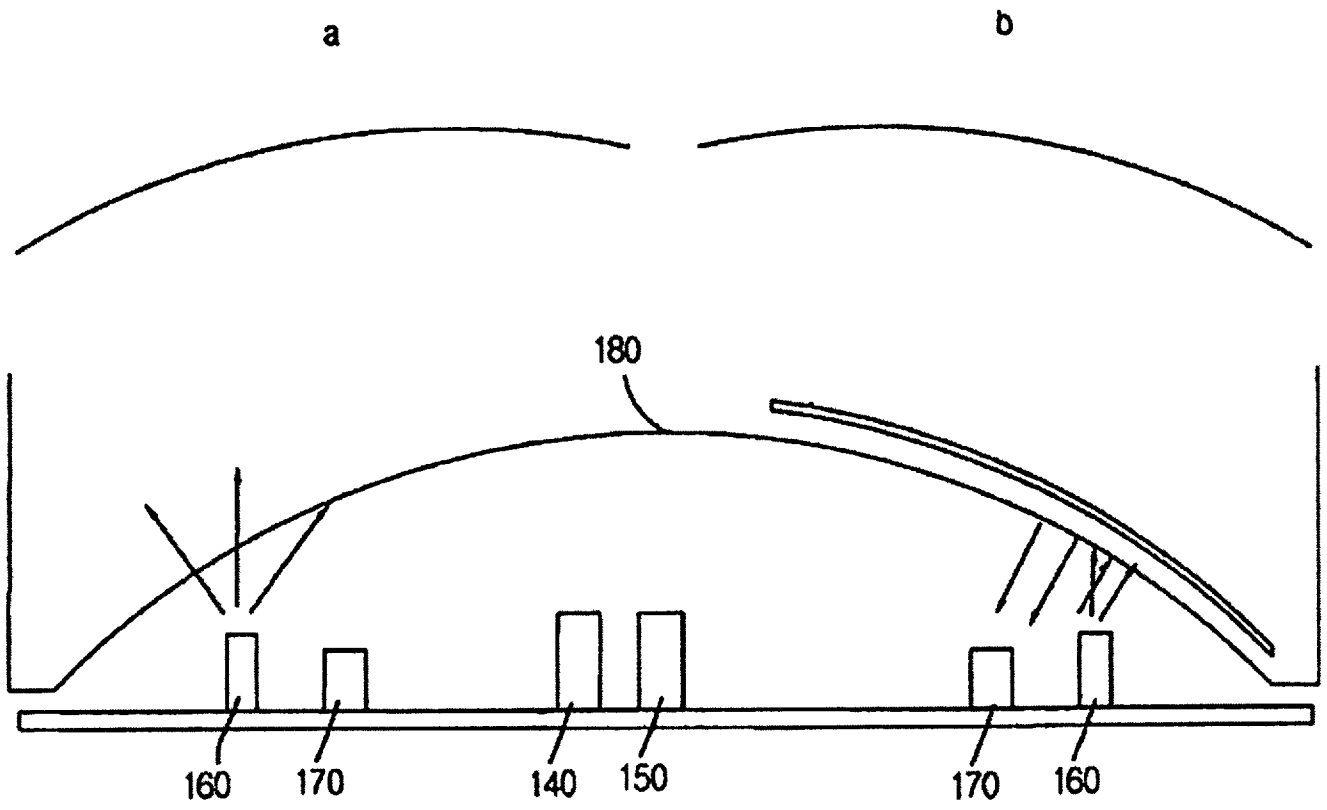
FIG. 3 is a cross section showing the characteristics of the snow removing apparatus of an LED traffic signal light according to the present invention.

FIG. 1 is a block diagram illustrating the LED traffic signal light according to the present invention, FIG. 2 is a circuit diagram for the snow removing apparatus of an LED traffic signal light according to the present invention, and FIG. 3 is a cross section showing the characteristics of the snow removing apparatus of an LED traffic signal light according to the present invention.

The LED traffic signal light according to the present invention, which is a traffic signal light having a snow removing function, comprises a power supply device that supplies power to the traffic signal light and a heater coil heating unit. An infra-red emitting unit having an infra-red emitting means installed thereon and an infra-red receiving unit having an infra-red receiving means installed thereon are installed additionally on the inside face or PCB of the lens to emit infra-red rays when snow accumulates on the lens and receive the emitted infra-red rays to convert and amplify the same into electrical power, with the amplified output turning on a power transistor in the heater coil heating unit, heating the heating coils.

The power supply device employed in the present invention further comprises: a power supply means that switches DC current from a primary coil to a secondary coil according to the switching action of a switching transistor; a control signal generating means that is connected to the secondary coil and which generates a control signal to control the duty ratio of the switching transistor; a control means that receives a signal output by the control signal generating means and controls the switching of the switching transistor to adjust the size of the voltage induced in the secondary coil of the power supply means; a power factor regulating means that improves the power factor of the power supply means; a ripple voltage prevention means to block ripple voltage of the power supply means; a resistor wherein a plurality of resistors connected serially to the secondary coil are parallelly connected between the control signal generating means and the load side of the control signal generating means while being connected between the part of the serially connected plurality of resistors from which a reference voltage output to the control signal generating means is drawn and the output ground wire, and; a reference voltage generating means that includes a negative temperature coefficient thermistor to vary the resistor value according to temperature changes of the parallelly connected resistors.

By virtue of the above-described structure, in the present invention, the LED traffic signal light does not unnecessarily flash on and off even when a lamp on signal is not applied. Also, the present invention has an improved power factor, always operates stably regardless of temperature changes, and promotes safe and smooth traffic flow as snow does not accumulate on the lens.

Referring to FIGS. 1 through 3, the control signals (10, 20, 30, 40) employed by the present invention may be for red, green, amber, and arrow signal lights.

These control signals (10, 20, 30, 40) are fed to a constant voltage (110) through a rectifier, supplying power to the internal drive circuit.

This control requires a phase detector (50), and the detected phase passes through a scale & offset (80) and PWM driver (90) in a phase counter control unit (60), where the applied voltage is compared to configure an internal control cycle counter.

The decision whether or not to supply a current to the heater through the heater control unit (70) is made according to the phase detector (50).

When all control preparations are complete, a power source device (120) supplies power to and resets the phase counter (60).

The conditions for controlling a current flowing to the heater are as follow.

In a flashing recognition unit (130), if flashing occurs at the same interval for at least 10 to 20 flashes, a microcomputer (100) recognizes a flashing state. To compensate for the loss of heat while the lamp is off when flashing, the current of the heater is increased to switch the PWM driver (90) and pulse to DC, while the voltage applied through the scale & offset (80) controls the heater through the heater control unit (70) via the phase counter control unit (60).

The purpose of a CDS sensor (140) is to stably receive an infra-red modulation signal from the infra-red emitting unit (160). That is, in the process of infra-red being emitted from the infra-red emitting unit (160) and being reflected by a lens (180) for receiving by an infra-red receiving unit (170), interference occurs from infra-red rays included in sunlight passing through the lens (180). The output of the infra-red emitting unit (160) is varied to compensate for this.

A thermometer (150) measures the internal temperature of the LED signal light, while changes in voltage are analyzed by the microcomputer (100). If the measured temperature is above zero, the heater is not operated, and if the temperature is below zero, the heater is operated. Also, if the temperature drops farther below zero, the current to the heater is increased to increase heat generated and improve the efficiency of the snow removal function.

In this embodiment of the present invention, the thermometer (150) detects temperatures using an NTC element.

Whereas the basic function of the infra-red emitting unit (160) and the infra-red receiving unit (170) in the snow removal function is to detect snow, they can also be used to determine an infra-red modulated output level and set a detection time point. The method for this is as follows. A settings command is transmitted using a remote control that has been specially fabricated to contain a setting command, after which a sample with an appropriate reflection coefficient is used to cover the lens (180). Then, the infra-red modulation of the infra-red emitting unit (160) is varied to find the point at which the infra-red receiving unit begins detecting infra-red. The output of the infra-red emitting unit (160) at this point represents the output obtained after correcting the angles of the components following assembly, and is therefore saved in internal storage.

Through this method, it is possible to measure and accurately and precisely control the output levels of a multiplicity of sensors.

Sunlight contains visible light, infra-red light and ultraviolet light, and the infra-red light contained in sunlight causes a phenomenon wherein it attenuates the infra-red modulation signal emitted by the infra-red emitting unit (160). To compensate for this, the CDS sensor (140) is used to measure sunlight and analyze the infra-red component contained therein and accordingly compensate the output of the infra-red emitting unit (160) to allow for stable infra-red detection.

The thermometer (150) uses an NTC thermistor, which is a temperature-detecting element, to determine the amount of heat applied to the heater depending on outside air temperature in the winter. As the temperature drops farther below zero, the amount of power to the heater is relatively increased so that snow is removed faster.

Further, in weather that is above zero, even if reflecting material such as snow is on the lens, the heater is not operated.

According to the present invention, in order to detect "snow", an infra-red modulation code is transmitted within the signal light, and the data from its reflection by snow that has accumulated on the lens (180) is analyzed. The lens (180) is transparent, meaning that weak infra-red data is not reflected, while, as seen in 'a' of FIG. 3, signals that are not reflected but pass through the lens can be read. However, as can be seen in 'b' of FIG. 3, if snow has accumulated on the lens (180), the accumulated snow increases the amount of the signal reflected, allowing for reading of the signal.

According to the present invention, in order to determine the strength of the infra-red modulation code that is emitted to detect the presence of snow, a specimen having a low reflection coefficient may be used to reflect a modulation code, which is detected (received) and analyzed. The infra-red emitting level is increased or decreased accordingly, be analyzing when the infra-red receiving unit (170) begins receiving a signal and setting the output level at this point as the reference output value.

To determine the reference output value, power is supplied to the unit, after which a settings command is entered into the infra-red receiving unit (170) using a remote control, after which the lens is covered with a sample having a low reflection coefficient. From this point, the emitting output of the infra-red emitting unit (160) is varied from the microcomputer (100), and the reference value for infra-red emitting output is determined by when the infra-red receiving unit (170) is triggered. Here, there may be a multiplicity of infra-red emitting units and a multiplicity of infra-red receiving units (170).

According to the present invention, to perform calibrations independent of the assembly angle and assembly characteristics of the lens (180) and the infra-red emitting unit (160), the receiving unit of the sensor is used instead of a separate button on the product to receive a command signal from a specially fabricated remote control. This command signal is forwarded to the microcomputer (100), where, as described in the above, the reflection angle of the lens and the infra-red emitting unit can be analyzed, after which the infra-red emitting level can be determined.

The present invention is characterized in that it uses a CDS sensor (140) to accurately recognize snow that needs to be removed. As means to remove the snow, the present invention may, in addition to a heat coil and heater, use means such as heaters with blowing functions or wipers.

Further, the present invention has an automatic flashing recognition function which recognizes a flashing mode and compensates for the loss in heat generated when a lamp is off during flashing. If the microcomputer (100) detects that power is in flashing mode, PWM (90) data is increased according to the duration of time during which the light is turned off in order to correct for the time the light is off, and a phase counter increases a power control counter to cause a heater control unit to increase the heat generation of a heater.

The present invention, having the above structure, provides a lens and heating coils for more effective snow removal, where the operation of the heating coils is controlled by the microcomputer (100) and a heater control unit (70).

Meanwhile, among the terms used to describe the present invention, 'inside' refers to a direction in which a heater control unit (70), etc., is installed, while 'outside' refers to a direction in contact with outside air.

Figure 4:
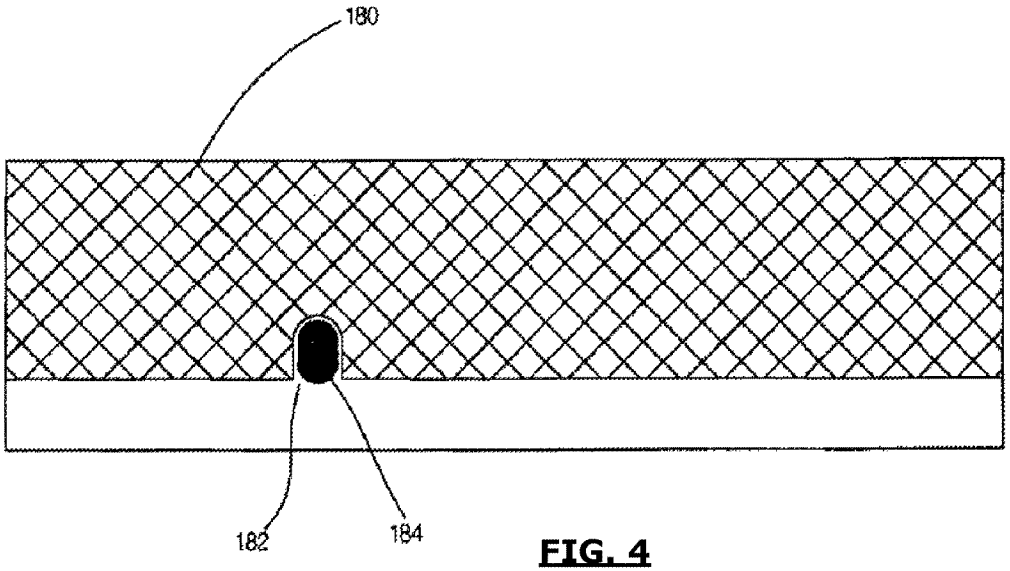
FIG. 4 is a plan drawing of the lens employed in the snow removing apparatus of an LED traffic signal light according to the present invention.
Figure 5:
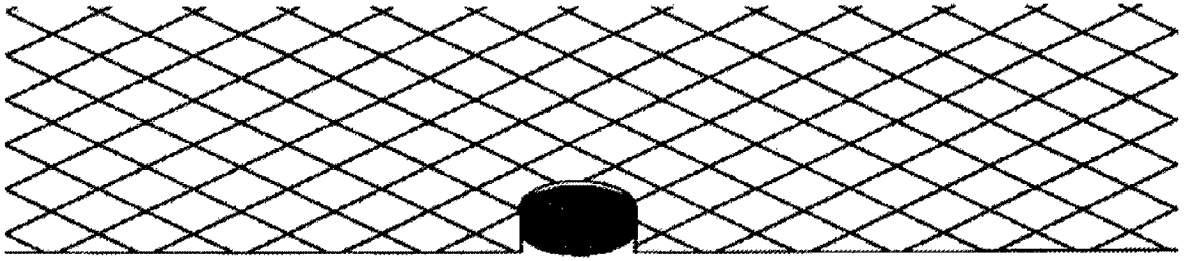
FIG. 5 is a magnified drawing of a heater securing groove employed in the snow removing apparatus an LED traffic signal light according to the present invention.

FIG. 4 is a plan drawing of the lens employed in the snow removing apparatus of an LED traffic signal light according to the present invention, and FIG. 5 is a magnified drawing of a heater securing groove employed in the snow removing apparatus of an LED traffic signal light according to the present invention.

As illustrated in FIG. 4 and FIG. 5, the lens (180) employed by the present invention comprises a gently curved surface.

Normally, the lens is formed of synthetic resin, with a gentle curved face that is convex toward the outside, but this is but a single embodiment, and a flat shape may also be employed.

On the inside of the lens (180) are ceramic-coated coil securing grooves (182) along the inside surface, and inside the coil securing grooves (182), heater coils (184) are inserted and installed.

The coil securing grooves (182) are in direct contact with the heater coil (184), and may be subject to deformation by the heat generated by the heater coils (184).

The temperature at which synthetic resin is thermally deformed is 150 degrees, but even if the heater coils (184) generate temperatures in excess of this, a ceramic coating formed in the coil securing grooves (182) allows for sufficient resistance to deterioration.

The coil securing grooves (182) are formed with a constant depth and width on the inside face of the lens (180).

In the present invention, as illustrated in FIG. 5, the length from inside to outside is referred to as the height, while the direction extending perpendicular to the height is referred to as the width.

The heater coils (184) employed by the present invention are formed by twisting and winding a coil material around a central carbon fiber core, then coating with a temperature-buffering insulating material for high temperatures.

The silicone employed by the present invention has a thermal deformation temperature of 300 degrees, and therefore is able to sufficiently withstand the heat conducted from the heater coils (184). By virtue of the impact absorbing effect typical of silicone, it is well able to expand and restore even when thermally deformed, and it is able to remain flexible even when installed in the coil securing grooves (182).

Whereas the heater coils (184) are installed by inserting into the coil securing grooves (182), the heater coils (184) are pressed into the coil securing grooves (182), making a separate adhesive to join them with the coil securing grooves (182) unnecessary.

INDUSTRIAL APPLICABILITY

Whereas, in the description above, the present invention has been explained with reference to embodiments, the present invention is not necessarily limited thereto, and it should be evident to a PHOSITA that various substitutions, modifications and alterations are possible without departing from the technical idea of the present invention. Accordingly, all of the preceding embodiments are in all aspects but exemplary, and should not be interpreted as limiting. The scope of the present invention is indicated in the appended claims, and is in no way bound to the specification. Further, alterations or modifications falling in the scope of the claims or their equivalents are all within the scope of the present invention.

The invention claimed is:

1. A snow removing apparatus of an LED traffic signal light, the snow removing apparatus comprising:

a lens, in which an infrared emitter and an infrared receiver, which receives infrared reflected from the infrared emitter, are installed, the lens including a CDS sensor configured to sense visible light to compensate for a transmission output power of the infrared emitter; and a heater coil installed in the lens and configured to generate heat, wherein the lens includes a gently curved surface and an inside surface of the lens is coated with ceramic, wherein a coil fixing groove having a constant depth and a constant width is formed from the inside surface of the lens to an outer surface of the lens, wherein the constant depth is greater than the constant width, wherein the heater coil, of which a width is greater than the constant width, is inserted by pressure into the coil fixing groove, wherein the heater coil includes a carbon fiber in a center thereof and an insulator which twists the carbon fiber, and is coated with silicone which starts a thermal deformation at 300° C. and is flexible to accommodate expansion and contraction according to the thermal deformation, wherein the CDS sensor is installed on an inside of the lens, wherein in the heater coil receives electrical power to generate heat, wherein the heater coil recognizes a flashing power mode through a microcomputer and carries out an automatic flashing recognition function, wherein PWM data is increased according to a duration of time during which the light is turned off in order to correct for the reduced heat generation caused by the light being turned off, and wherein a phase counter increases a power control counter to cause a heater controller to increase the heat generation of the heater coil.

2. The snow removing apparatus according to claim 1, further comprising a power supply including:

a power supplier configured to switch DC current from a primary coil to a secondary coil according to a switching action of a switching transistor;

a control signal generator connected to the secondary coil and which generates a control signal to control the duty ratio of the switching transistor;

a controller configured to receive a signal output by the control signal generator and to control the switching action of the switching transistor to adjust an amplitude of the voltage induced in the secondary coil of the power supplier;

a power factor regulator configured to improve a power factor of the power supplier;

a ripple voltage preventer to block ripple voltage of the power supplier;

a resistor wherein a plurality of resistors connected serially to the secondary coil are parallelly connected between the control signal generator and the load side of the control signal generator while being connected between the part of the serially connected plurality of resistors from which a reference voltage output to the control signal generating means is drawn and the output ground wire; and a reference voltage generator that includes a negative temperature coefficient thermistor to vary a resistor value according to temperature changes of the parallelly connected resistors.

* * * * *